US006366009B1

(12) United States Patent
Smith et al.

(10) Patent No.: US 6,366,009 B1
(45) Date of Patent: Apr. 2, 2002

(54) METHOD FOR FABRICATING A FIELD EMISSION DISPLAY HAVING A SPACER WITH A PASSIVATION LAYER

(75) Inventors: Peter A. Smith; Joyce K. Yamamoto, both of Chandler; Craig Amrine, Tempe; Thomas Nilsson, Phoenix; Steven M. Smith, Gilbert, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/365,197

(22) Filed: Aug. 2, 1999

(51) Int. Cl.[7] ..... H01J 19/42; H01J 9/02
(52) U.S. Cl. ..... 313/292; 445/25; 313/495
(58) Field of Search ..... 313/292, 495, 313/496, 285; 445/24, 25

(56) References Cited

U.S. PATENT DOCUMENTS

| | | | |
|---|---|---|---|
| 5,675,212 A | 10/1997 | Schmid et al. | 313/422 |
| 5,742,117 A | 4/1998 | Spindt et al. | 313/422 |
| 5,898,266 A | 4/1999 | Spindt et al. | 313/495 |

FOREIGN PATENT DOCUMENTS

| | | |
|---|---|---|
| WO | 9630926 | 10/1996 |
| WO | WO9816326 | 10/1997 |
| WO | 9934390 | 7/1999 |

*Primary Examiner*—Michael H. Day
*Assistant Examiner*—Joseph Williams
(74) *Attorney, Agent, or Firm*—Kevin D. Wills; William E. Koch

(57) ABSTRACT

A method for fabricating a field emission display (100) includes the steps of providing a cathode plate (102), providing an anode plate (104), providing a spacer substrate (160) made from a bulk spacer material (109), cutting the spacer substrate (160) to define a spacer (108) having a surface (107), passivating the surface (107) of the spacer (108) using the bulk spacer material (109) to form a passivation layer, and disposing the spacer (108) between the cathode plate (102) and the anode plate (104). A field emission display (100) which includes a cathode plate (102) having a plurality of electron emitters (124), an anode plate (104) opposing the cathode plate (102), and a spacer (108) extending between the cathode plate (102) and anode plate (104). The spacer (108) has a passivation layer made from bulk spacer material (109).

29 Claims, 1 Drawing Sheet

METHOD FOR FABRICATING A FIELD EMISSION DISPLAY HAVING A SPACER WITH A PASSIVATION LAYER

FIELD OF THE INVENTION

The present invention pertains to field emission displays and, more particularly, to a method of fabricating spacers for field emission displays.

BACKGROUND OF THE INVENTION

It is known in the art to make spacer structures for use in field emission displays for the purpose of maintaining the separation between the cathode and the anode plates. Spacer materials commonly used are insulating in nature so that anode electrical potential is held off of the cathode plate. Failure of a spacer, typically in the form of a violent electrical discharge/arcing, results in catastrophic damage to the display. One known mechanism, which can result in such failure, is a reduction of component elements in the spacer material leading to a change in the insulative properties of the spacer material. For example, titanate based material systems are susceptible to reduction in the Ti—O bond due to electron bombardment which can lead to Ti rich, conductive regions on the spacer surface. Once these regions form, conduction paths become present and arcing can occur causing display failure.

Several prior art spacers attempt to solve the problems of spacer breakdown and associated arcing. For example, it is known in the art to provide a spacer having a resistive coating. The resistive coating is applied over the bulk spacer material to prevent spacer material breakdown due to electron bombardment and to remove impinging electrons by conduction. However, these coatings are susceptible to mechanical damage and/or alteration, such as may occur during handling of the spacers. They are also susceptible to chemical alteration, which may change their resistivity. Another disadvantage to coated spacers is a thermal expansion mismatch between bulk spacer material and spacer coating which can cause interfacial stresses between the bulk spacer material and spacer coating. This can lead to cracks in the coating and spacer breakdown. Spacer coating methods employ additional processing steps in the fabrication of a field emission display which, adds time, complexity and cost to the process. In addition, maintaining coating thickness during fabrication is problematic due the complex coating process and additional handling of spacers after the coating process.

Accordingly, there exists a need for a method of fabricating a field emission display having passivated spacers which eliminates the need for a spacer coating, prevents spacer breakdown due to electron bombardment and is simple and cost effective.

BRIEF DESCRIPTION OF THE DRAWINGS

Referring to the drawings.

DETAILED DESCRIPTION

An embodiment of the invention is for a method of fabricating a field emission display having a spacer with a passivation layer. The method includes providing a cathode plate, anode plate and spacer substrate. The spacer substrate is cut to define the spacer with a surface. Subsequently, forming a passivation layer out of the bulk spacer material passivates the surface of the spacer. The passivated spacer is subsequently disposed between the cathode and anode plate.

The method of the invention has numerous advantages. For example, the material reduction of spacer surfaces due to electron bombardment is eliminated utilizing the bulk spacer material. This has the advantage of eliminating spacer coatings and the associated thermal expansion mismatch that can lead to interfacial stresses between spacer bulk material and spacer coating. The elimination of these stresses prevents cracking at the surface of the spacer and the associated breakdown of the spacer due to electron bombardment. Another advantage of the method of the invention is the creation of a more robust spacer through the elimination of the spacer coating. All of these advantages provide cost savings through increased spacer yield and reduced processing time for the fabrication of field emission displays.

Figure 1:
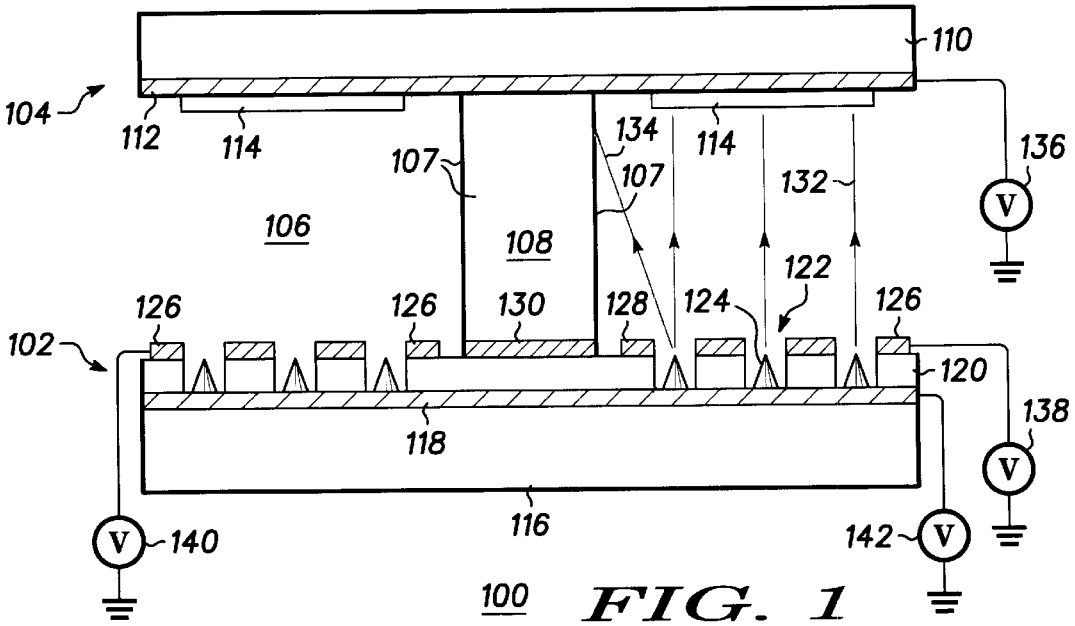
FIG. 1 is a cross-sectional view of a field emission display realized by performing various steps of an embodiment of a method of the invention.

FIG. 1 is a cross-sectional view of a field emission display (FED) 100 realized by performing various steps of an embodiment of a method of the invention. FED 100 has a cathode plate 102, which opposes an anode plate 104. An evacuated region 106 exists between cathode plate 102 and anode plate 104. The pressure within evacuated region 106 is less than about $10^{-6}$ Torr. A spacer 108 having a surface 107 extends between cathode plate 102 and anode plate 104. Spacer 108 can include a bonding layer 130. Bonding layer 130 can be made from, for example, a metal, metal alloy, ceramic-metal composite and the like.

Cathode plate 102 includes a substrate 116, which can be made from glass, silicon, and the like. Upon substrate 116 is disposed a cathode 118, which can include a thin layer of molybdenum, and the like. A dielectric layer 120 is formed on cathode 118. Dielectric layer 120 can by made from, for example, silicon dioxide. Dielectric layer 120 defines a plurality of emitter wells 122, in which are disposed one each a plurality of electron emitters 124. In the embodiment of FIG. 1, electron emitters 124 include Spindt tips.

However, a field emission display in accordance with the method of the invention is not limited to Spindt tip electron sources. For example, an emissive carbon film can alternatively by employed for the electron source of cathode plate 102.

Cathode plate 102 further includes a plurality of gate extraction electrodes. A first gate extraction electrode 126 and a second gate extraction electrode 128 are illustrated in FIG. 1. In general, the gate extraction electrodes are used to selectively address the electron emitters 124.

Anode plate 104 includes a transparent substrate 110, upon which is formed an anode 112, which is transparent and can include a thin layer of indium tin oxide. A plurality of phosphors 114 is disposed upon anode 112. Phosphors oppose electron emitters 124.

A first voltage source 136 is connected to anode 112. A second voltage source 138 is connected to second gate extraction electrode 128. A third voltage source 140 is connected to first gate extraction electrode 126, and a fourth voltage source 142 is connected to cathode 118.

During the operation of FED 100, potentials are applied to first and second gate extraction electrodes 126, 128, cathode 118, and anode 112 to cause selected electron emission current 132 at electron emitters 124 and direct electrons through evacuated region 106 toward phosphors 114. Phosphors 114 are caused to emit light by the impinging electrons. When electron emitters 124 proximate to spacer 108 are caused to emit electrons, some of these electrons impinge upon spacer 108 as indicated by an arrow 134 in FIG. 1. These impinging electrons 134 can cause reduction in the spacer material and corresponding spacer breakdown.

Spacer 108 provides mechanical support to maintain the separation between cathode plate 102 and anode plate 104. One end of spacer 108 contacts anode plate 104, at a surface that is not covered by phosphors 114. The opposing end of spacer 108 contacts cathode plate 102, at a portion that does not define emitter wells 122. The height of spacer 108 is sufficient to aid in the prevention of electrical arcing between cathode plate 102 and anode plate 104.

In the embodiment of the method of the invention shown in FIG. 1, spacer 108 is a rectangular platelet, which has a height in the range of 200–2000 micrometers and a width in the range of 10–250 micrometers. These dimensions depend upon on the predetermined spacing between cathode plate 102 and anode plate 104, the dimension of the space available for spacer placement on the cathode plate 102 and anode plate 104, and the load bearing requirements of each spacer 108.

However, a field emission display in accordance with the method of the invention is not limited to spacers 108 with rectangular geometry. For example, spacer 108 can alternatively be cylindrical, T-shaped, and the like. The method of the invention is not limited to any particular spacer geometry and includes any spacer geometry within a field emission display 100.

Figure 2:
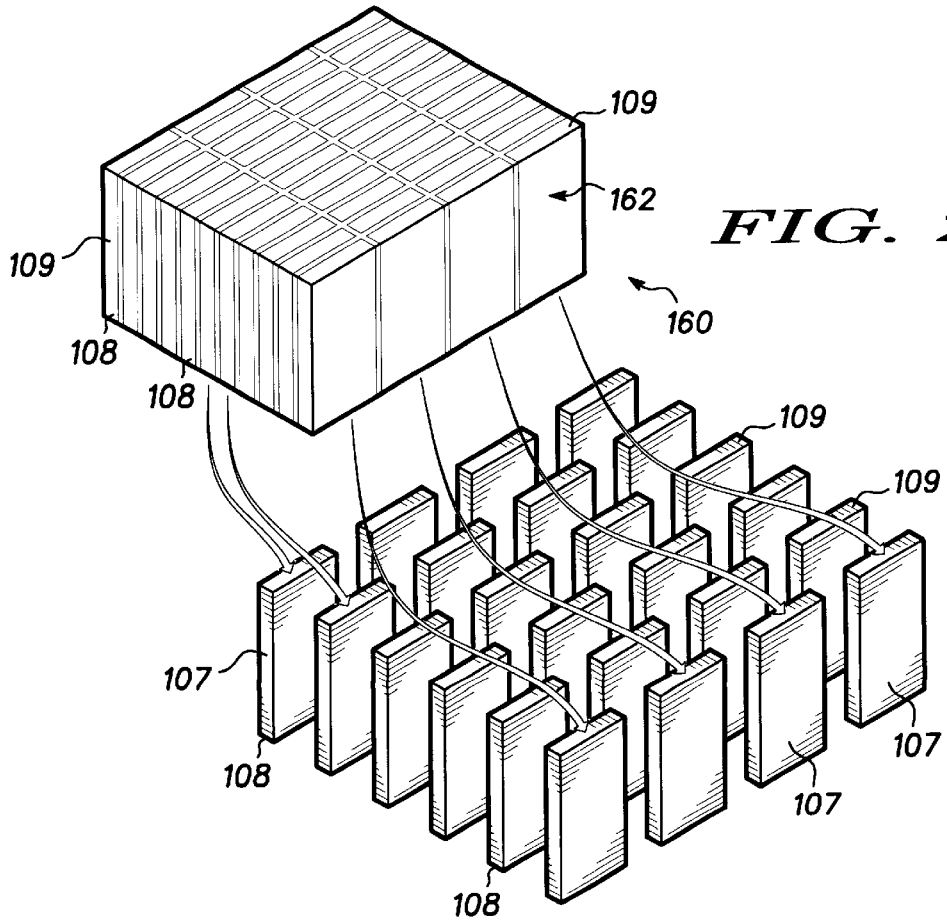
FIG. 2 is an isometric view of a spacer substrate realized by performing various steps of an embodiment of a method of the invention.

FIG. 2 is an isometric view of a spacer substrate 160 realized by performing various steps of an embodiment of a method of the invention. The upper portion of FIG. 2 illustrates the spacer substrate 160 before cutting of the spacers 108. The spacer substrate 160 has a surface 162. The bottom portion of FIG. 2 illustrates a portion of spacer substrate 160 after cutting of spacers 108. The invention is not limited to the embodiment of spacer substrate depicted in FIG. 2. The invention encompasses any geometric form of spacer substrate 160 and spacer 108. The spacer substrate 160 and spacers are made from bulk spacer material 109. Bulk spacer material 109 can be made from, for example, a metal-oxide, ceramic-metal oxide, and the like. Exemplary bulk spacer materials 109 for use in the embodiment of the method of the invention include niobate materials, tantalate materials, titanate materials, titania ($TiO_2$), and the like.

For example, useful titanate materials include barium titanate, strontium titanate, strontium calcium titanate ($(Sr,Ca)TiO_3$), calcium magnesium titanate ($(Ca,Mg)TiO_3$), rare earth barium titanates, and the like. Exemplary rare earth barium titanates are samarium barium titanate ($BaSm_2TiO_6$); neodymium barium titanate; and rare earth barium titanates having the general formula $BaRE_2Ti_4O_{12}$, wherein RE is a rare earth trivalent cation (e.g. La, Sm); and the like. The neodymium barium titanate material can be a mixture of three phases: a first phase of $Nd_2BaTi_5O_{(17.5-x)}$, wherein $0<x<3.5$, a second phase of $NdTiO_3$, and a third phase of $Nd_2Ti_2O_7$. Another useful material is a mixture of barium titanate and the titanate of one or more other Group IIA elements of the Periodic Table. Exemplary niobate materials are bismuth-based niobates, such as zinc bismuth niobate ($Bi_2(ZnNb_2)O_9$), nickel bismuth niobate ($Bi_3(Ni_2Nb)O_9$), and the like.

A method for fabricating FED 100 in accordance with an embodiment of the invention will now be described. First, methods of forming cathode plate 102 and anode plate 104 are known to one skilled in the art. Spacer 108 having a passivation layer is made by first providing a spacer substrate 160 made of bulk spacer material 109. Such sheets are commercially available.

Bonding layer 130 can be attached to an end of spacer 108 by any number of standard deposition techniques, for example, vacuum deposition, thick film deposition, and the like. The spacer substrate 160 is then cut into platelets or another geometry useful for spacer 108. The cutting step can be accomplished by using one of a number of convenient cutting methods, such as by cutting with a wire saw, a dicing saw, a laser, a water jet, and the like. The invention is not limited to applying the bonding layer 130 before cutting of spacer substrate 160. Bonding layer 130 can also be applied to spacer 108 before spacer substrate 160 is cut to form spacers 108. Subsequently, After spacer 108 has been made, the surface 107 of spacer 108 is passivated using the bulk spacer material 109 to form the passivation layer.

In an embodiment of a method of the invention, spacer 108 is heat treated in a nitrogen atmosphere. In an example of an embodiment of the method of the invention bulk spacer material 109 is made from titanate and spacer 108 can be passivated using chemical vapor deposition (CVD) with ammonia ($NH_3$). In this embodiment spacer 108 is heat treated to a temperature in the range of 200–600 degrees Celsius (°C.), preferably 200–400° C. for a time period of at least 30 seconds. The temperature must not exceed the melting point of the conductive material used for bonding layer 130. In this example, aluminum was used. Other bonding layer materials include gold, nickel, copper, chrome, and the like.

The passivation of the surface 107 of spacer is not limited to CVD with ammonia. Other methods can be employed, for example, plasma enhanced CVD, rapid thermal processing, thermal processing, and the like. Other nitrogen sources can also be employed, for example, nitrogen gas, and the like.

In this example of the method of the invention, the metal-oxygen bonds (titanium-oxygen bonds (Ti—O) in this example) of the bulk spacer material 109 are broken at the surface 107 of the spacer 108 and replaced with metal-nitrogen bonds (titanium-nitrogen (Ti—N) in this example). The replacement of Ti—O bonds with Ti—N bonds in the bulk spacer material 109 on the surface 107 of spacer 108 has the benefit of creating a chemically and mechanically stable passivation layer on spacer 108. The passivation layer is more resistant to electron beam degradation than Ti—O and prevents reduction of bulk spacer material 109 during electron bombardment shown by arrow 134 in FIG. 1. Since the metal-oxygen bonds are eliminated from the surface 107 of spacer 108, the reduction of oxygen and the associated development of metal rich, conductive regions on the surface 107 of the spacer 108 is prevented during operation of FED 100. Since the passivation layer is formed from the bulk spacer material 109, the method of the invention has the further benefit of eliminating the need for a spacer coating. This has the benefit of eliminating the thermal expansion mismatch and variable coating thickness of prior art spacers, which leads to interfacial stresses and cracking at the surface of the spacer and subsequent spacer breakdown. All of these benefits lead to a more robust spacer that provides the benefit of cost savings through increased spacer yield and reduced processing time for the fabrication of field emission displays 100.

In another embodiment of a method of the invention, spacer 108 is heat treated in a non-reducing atmosphere. This has the effect of oxidizing the bulk spacer material 109 at the surface 107 of spacer 108, which creates a passivation layer. A non-reducing atmosphere can include, for example, an oxidizing atmosphere, air, oxygen, and the like. In an example of an embodiment of the method of the invention bulk spacer material 109 is made from metal-oxide materials such as niobate materials, tantalate materials, titanate materials, titania ($TiO_2$), and the like. In this embodiment spacer 108 is heat treated to a temperature in the range of 200–600° C., preferably 400–600° C. for a time period of at least 30 seconds, preferably in the range of 30 seconds to 1 hour. The temperature must not exceed the melting point of the material used for bonding layer 130.

In this embodiment of the method of the invention the surface 107 of spacer 108 is oxidized which reduces the risk of breakdown by pushing the chemical reaction that leads to reduction of bulk spacer material 109 away from reduction. In other words, by oxidizing the surface 107 of spacer 108, thereby creating a passivation layer, the chances of reduction on the surface 107 of spacer 108 are reduced during electron bombardment.

In yet another embodiment of the method of the invention spacer substrate 160 is heat treated in a non-reducing atmosphere prior to cutting of spacer substrate to define spacer 108. This has the effect of oxidizing the surface 162 of spacer substrate 160, which creates a passivation layer. A non-reducing atmosphere can include, for example, an oxidizing atmosphere, air, oxygen, and the like. In this embodiment spacer substrate is heat-treated to a temperature sufficient to sinter the bulk spacer material 109. As an example, titanate is heat-treated to a temperature within a range of 800–1400° C., preferably 1000–1200° C. for a time period of at least 1 hour, preferably in the range of 1–3 hours. This embodiment has the advantage of eliminating the temperature limitation imposed by the presence of bonding layer 130.

The fabrication of the field emission display 100 further includes disposing the spacer 108 between the cathode plate 102 and anode plate 104. Spacer 108 can be secured to either cathode plate 102 or anode plate 104 using one of a number of convenient attachment methods, such as by heating of the spacer, laser welding, and the like.

In summary, it should now be appreciated that the present invention provides a method of fabricating a field emission display having a spacer with a passivation layer. The method allows a passivation layer to be formed from bulk spacer material, which eliminates the breakdown of spacer due to reduction of bulk spacer material during electron bombardment, eliminates the need for spacer coatings and provides cost savings through increased spacer yields and reduced processing time in the fabrication of field emission displays.

What is claimed is:

1. A method for fabricating a field emission display having a spacer with a passivation layer comprising the steps of:

providing a cathode plate;

providing an anode plate;

providing a spacer substrate comprising a bulk spacer material;

concurrently with the step of providing a spacer substrate, heat treating the spacer substrate in a non-reducing atmosphere;

cutting the spacer substrate to define the spacer, wherein the spacer has a surface;

passivating the surface of the spacer, wherein the bulk spacer material on the surface of the spacer forms the passivation layer; and disposing the spacer between the cathode plate and the anode plate.

2. The method for fabricating a field emission display as claimed in claim 1, wherein the bulk spacer material is comprised of a material selected from a group consisting of metal-oxides and ceramic-metal oxides.

3. The method for fabricating a field emission display as claimed in claim 2, wherein the bulk spacer material is comprised of a material selected from a group consisting of niobates, tantalates, titanates and titania.

4. The method for fabricating a field emission display as claimed in claim 3, wherein the bulk spacer material is comprised of a material selected from a group consisting of barium titanate, strontium titanate, strontium calcium titanate, calcium magnesium titanate, rare earth barium titanates, and a mixture of barium titanate and a titanate of another Group IIA element.

5. The method for fabricating a field emission display as claimed in claim 2, wherein the step of passivating the surface of the spacer further includes the step of heat-treating the spacer in a nitrogen atmosphere.

6. The method for fabricating a field emission display as claimed in claim 5, wherein the step of heat-treating the spacer comprises the step of heat-treating the spacer to a temperature within a range of 200–600 degrees Celsius.

7. The method for fabricating a field emission display as claimed in claim 6, wherein the step of heat-treating the spacer comprises the step of heat-treating the spacer to a temperature within a range of 200–400 degrees Celsius.

8. The method for fabricating a field emission display as claimed in claim 5, wherein the step of passivating the surface of the spacer comprises the step of replacing a plurality of metal-oxide bonds of the bulk spacer material with a plurality of metal-nitrogen bonds on the surface of the spacer, thereby providing the passivation layer on the surface of the spacer.

9. The method for fabricating a field emission display as claimed in claim 2, wherein the step of passivating the surface of the spacer further includes the step of heat-treating the spacer in a non-reducing atmosphere.

10. The method for fabricating a field emission display as claimed in claim 9, wherein the step of heat-treating the spacer comprises the step of heat-treating the spacer to a temperature within a range of 200–600 degrees Celsius.

11. The method for fabricating a field emission display as claimed in claim 10, wherein the step of heat-treating the spacer comprises the step of heat-treating the spacer to a temperature within a range of 400–600 degrees Celsius.

12. The method for fabricating a field emission display as claimed in claim 9, wherein the step of passivating the surface of the spacer further includes the step of heat-treating the spacer in an oxidizing atmosphere.

13. The method for fabricating a field emission display as claimed in claim 9, wherein the step of passivating the surface of the spacer further includes the step of heat-treating the spacer in an air atmosphere.

14. The method for fabricating a field emission display as claimed in claim 9, wherein the step of passivating the surface of the spacer further includes the step of heat-treating the spacer in an oxygen atmosphere.

15. The method for fabricating a field emission display as claimed in claim 9, wherein the step of passivating the surface of the spacer comprises the step of oxidizing the bulk spacer material on the surface of the spacer, thereby providing the passivation layer on the surface of the spacer.

16. The method for fabricating a field emission display as claimed in claim 1, wherein the step of heat-treating the spacer substrate is performed in an oxidizing atmosphere.

17. The method for fabricating a field emission display as claimed in claim 1, wherein the step of heat-treating the spacer substrate is performed in an air atmosphere.

18. The method for fabricating a field emission display as claimed in claim 1, wherein the step of heat-treating the spacer substrate is performed in an oxygen atmosphere.

19. The method for fabricating a field emission display as claimed in claim 1, wherein the spacer substrate includes a surface, and wherein the step of heat-treating the spacer substrate comprises the step of heat-treating the spacer substrate comprises the step of oxidizing the bulk spacer material at the surface of the spacer substrate, thereby providing the passivation layer on the surface of the spacer substrate.

20. The method for fabricating a field emission display as claimed in claim 1, wherein the step of heat-treating the spacer substrate comprises the step of heat-treating the spacer substrate to a temperature sufficient to sinter the bulk spacer material.

21. The method for fabricating a field emission display as claimed in claim 20, wherein the step of heat-treating the spacer substrate comprises the step of heat-treating the spacer substrate to a temperature within a range of 800–1400 degrees Celsius.

22. A field emission display having a passivated spacer comprising:

a cathode plate having a plurality of electron emitters, wherein the plurality of electron emitters are designed to emit an electron current;

an anode plate disposed to receive the electron current emitted by the plurality of electron emitters; and a spacer having a surface and comprising a bulk spacer material, the spacer including a heat treated spacer substrate and a passivation layer, wherein the spacer extends between the cathode plate and the anode plate, and wherein the bulk spacer material on the surface of the spacer forms a passivation layer.

23. The field emission display as claimed in claim 22, wherein the bulk spacer material is comprised of a material selected from a group consisting of metal-oxides and ceramic-metal oxides.

24. The field emission display as claimed in claim 23, wherein the bulk spacer material is comprised of a material selected from a group consisting of niobates, tantalates, titanates and titania.

25. The field emission display as claimed in claim 24, wherein the bulk spacer material is comprised of a material selected from a group consisting of barium titanate, strontium titanate, strontium calcium titanate, calcium magnesium titanate, rare earth barium titanates, and a mixture of barium titanate and a titanate of another Group IIA element.

26. The field emission display as claimed in claim 22, wherein the bulk spacer material on the surface of the spacer comprises metal-nitrogen bonds.

27. The field emission display as claimed in claim 22, wherein the bulk spacer material on the surface of the spacer comprises oxidized bulk spacer material.

28. A method for fabricating a field emission display having a spacer with a passivation layer comprising the steps of:

providing a cathode plate;

providing an anode plate;

providing a spacer substrate comprising a bulk spacer material;

cutting the spacer substrate to define the spacer, wherein the spacer has a surface;

passivating the surface of the spacer by heat-treating the spacer in a pure nitrogen atmosphere, wherein the bulk spacer material on the surface of the spacer forms the passivation layer; and disposing the spacer between the cathode plate and the anode plate.

29. A method for fabricating a field emission display having a spacer with a passivation layer comprising the steps of:

providing a cathode plate;

providing an anode plate;

providing a spacer substrate comprising a bulk spacer material;

cutting the spacer substrate to define the spacer, wherein the spacer has a surface;

passivating the surface of the spacer by heat-treating the spacer in a pure oxygen atmosphere, wherein the bulk spacer material on the surface of the spacer forms the passivation layer; and disposing the spacer between the cathode plate and the anode plate.

* * * * *